US010556657B1

(12) United States Patent
Broughton et al.

(10) Patent No.: US 10,556,657 B1
(45) Date of Patent: Feb. 11, 2020

(54) MARINE OUTBOARD ENGINE LUBRICATION

(71) Applicant: BRP US INC., Sturtevant, WI (US)

(72) Inventors: George Broughton, Wadsworth, IL (US); Mark C. Noble, Pleasant Prairie, WI (US); Richard McChesney, Waukegan, IL (US); Jeffrey Wasil, Kenosha, WI (US)

(73) Assignee: BRP US INC., Sturtevant, WI (US)

( * ) Notice: Subject to any disclaimer, the term of this patent is extended or adjusted under 35 U.S.C. 154(b) by 0 days.

(21) Appl. No.: 16/119,637

(22) Filed: Aug. 31, 2018

Related U.S. Application Data

(60) Provisional application No. 62/552,603, filed on Aug. 31, 2017.

(51) Int. Cl.

| | |
|---|---|
| ***B63H 20/00*** | (2006.01) |
| ***F01P 7/14*** | (2006.01) |
| *F02B 61/04* | (2006.01) |
| *F02B 75/20* | (2006.01) |
| *F01P 3/00* | (2006.01) |

(52) U.S. Cl.
CPC ..... *B63H 20/002* (2013.01); *F01P 7/14* (2013.01); *F01P 2003/006* (2013.01)

(58) Field of Classification Search
CPC ..... B63H 20/001; B63H 20/002; F01P 7/14; F01P 2003/006
USPC ..... 440/88 R, 88 L; 123/195 P, 196 CP, 123/196 M, 196 R
See application file for complete search history.

(56) References Cited

U.S. PATENT DOCUMENTS

| | | | | |
|---|---|---|---|---|
| 4,195,600 | A * | 4/1980 | Shingai | F01M 3/00 123/196 CP |
| 4,828,519 | A * | 5/1989 | Watanabe | F02B 61/045 440/49 |
| 4,832,641 | A * | 5/1989 | Oishi | B63H 21/38 123/195 P |
| 5,460,555 | A * | 10/1995 | Fukuoka | F01M 11/02 123/196 R |
| 5,524,581 | A * | 6/1996 | Rush, II | F01M 1/02 123/196 M |
| 5,870,991 | A * | 2/1999 | Mineno | F01M 1/02 123/196 R |
| 8,137,146 | B2 | 3/2012 | Cohen | |
| 2005/0009420 | A1 * | 1/2005 | Yoshida | F01M 11/02 440/88 L |

* cited by examiner

*Primary Examiner* — Daniel V Venne
(74) *Attorney, Agent, or Firm* — BCF LLP

(57) ABSTRACT

A marine outboard engine comprises an internal combustion engine, a gearcase defining a gearcase chamber, a plurality of gears disposed in the gearcase chamber, a driveshaft operatively connecting the crankshaft to the plurality of gears, an output shaft disposed at least in part in the gearcase chamber and being operatively connected to the plurality of gears, a rotor connected to the output shaft for propelling the marine outboard engine, a lubricant reservoir for holding lubricant, a first lubricant conduit fluidly connecting the lubricant reservoir to the crankcase chamber for supplying lubricant from the lubricant reservoir to the crankcase chamber, and a second lubricant conduit fluidly connecting the lubricant reservoir to the gearcase chamber for supplying lubricant from the lubricant reservoir to the gearcase chamber.

20 Claims, 10 Drawing Sheets

MARINE OUTBOARD ENGINE LUBRICATION

CROSS-REFERENCE

The present application claims priority to U.S. Provisional Patent Application No. 62/552,603, entitled "Marine Outboard Engine Lubrication", filed Aug. 31, 2017, the entirety of which is incorporated herein by reference.

TECHNICAL FIELD

The present technology relates to marine outboard engines and more specifically to the lubrication of marine outboard engines.

BACKGROUND

Marine outboard engines typically have components that need to be lubricated during operation.

For example, a typical gasoline-powered marine outboard engine requires engine oil to lubricate engine components, such as one or more pistons, bearings, pins and the like. A two-stroke internal combustion engine, which employs crankcase compression, consumes engine oil during combustion. As such, a two-stroke internal combustion engine typically has an oil reservoir that holds two-stroke engine oil and must periodically be replenished. In use two-stroke engine oil is drawn from the oil reservoir and fed into the engine for lubricating components in the engine.

In a further aspect, a typical marine outboard engine also has a gearcase containing transmission components that operatively connect an internal combustion engine assembly to a propeller or impeller. A gearcase fluid is held in the gearcase and lubricates the transmission components, including gears, bearings, clutches and the like. Over time, the gearcase fluid breaks down and loses its lubricating properties. Therefore, in order to maintain proper engine operation, maintenance must be performed periodically to replace the gearcase fluid. However, marine outboard engine maintenance, although necessary, is typically an inconvenience to users and involves costs, time, and often expertise.

Therefore, there is a desire to reduce engine maintenance requirements for users.

SUMMARY

It is an object of the present technology to ameliorate at least some of the inconveniences present in the prior art.

According to one aspect of the present technology, there is provided a marine outboard engine that has a lubrication system that lubricates certain components in both an engine assembly and in a gearcase of the outboard engine, from a single lubricant reservoir containing a single lubricant. As a result, the marine outboard engine has relatively fewer maintenance requirements with respect to the lubrication of the components of the marine outboard engine.

According to another aspect of the present technology, there is provided a marine outboard engine. The marine outboard engine includes an internal combustion engine. The internal combustion engine includes a crankcase defining a crankcase chamber, a cylinder block connected to the crankcase, the cylinder block defining a cylinder, a piston disposed in the cylinder, a crankshaft disposed at least in part in the crankcase chamber, and a connecting rod operatively connecting the piston to the crankshaft.

The marine outboard engine further includes a gearcase defining a gearcase chamber, a plurality of gears disposed in the gearcase chamber, a driveshaft operatively connecting the crankshaft to the plurality of gears, an output shaft disposed at least in part in the gearcase chamber and being operatively connected to the plurality of gears, a rotor connected to the output shaft for propelling the marine outboard engine, a lubricant reservoir for holding lubricant, a first lubricant conduit fluidly connecting the lubricant reservoir to the crankcase chamber for supplying lubricant from the lubricant reservoir to the crankcase chamber, and a second lubricant conduit fluidly connecting the lubricant reservoir to the gearcase chamber for supplying lubricant from the lubricant reservoir to the gearcase chamber.

In some implementations, the lubricant reservoir is disposed at least in part in front of the crankcase.

In some implementations, the lubricant reservoir is disposed at least in part above the internal combustion engine.

In some implementations, the output shaft is operatively connected to the plurality of gears to be selectively drivable by at least two of the plurality of gears.

In some implementations, the plurality of gears disposed in the gearcase chamber includes a pinion connected to an end of the driveshaft to be driven by the driveshaft, and a bevel gear connected to the output shaft in front of the pinion, the bevel gear being meshed with the pinion and driven by the pinion in a first direction.

In some implementations, the bevel gear is a first bevel gear, and the plurality of gears disposed in the gearcase chamber further includes a second bevel gear connected to the output shaft behind the pinion. The second bevel gear is meshed with the pinion and driven by the pinion in a second direction that is opposite the first direction. In some such implementations, the marine outboard engine further includes a dog clutch disposed in the gearcase chamber. The dog clutch is operable to selectively couple one of the first bevel gear and the second bevel gear to the output shaft to drive the output shaft in a corresponding one of the first and second direction.

In some implementations, the marine outboard engine includes a lubricant in the lubricant reservoir, the lubricant in the lubricant reservoir is a four-stroke engine oil, and the internal combustion engine is a two-stroke internal combustion engine.

In some implementations, the marine outboard engine includes a lubricant pump fluidly connecting the lubricant reservoir to the crankcase chamber via the first lubricant conduit for supplying lubricant from the lubricant reservoir to the crankcase chamber.

In some implementations, the lubricant pump is disposed in the lubricant reservoir.

In some implementations, the marine outboard engine includes a plurality of bearings rotationally connecting the crankshaft to the crankcase, the plurality of bearings being in fluid communication with the lubricant reservoir for receiving lubricant from the lubricant reservoir.

In some implementations, the first lubricant conduit supplies lubricant from the lubricant reservoir to at least one of the plurality of bearings.

In some implementations, the marine outboard engine includes a wristpin operatively connecting the piston to the connecting rod, the wristpin being in fluid communication with the lubricant reservoir for receiving lubricant from the lubricant reservoir.

In some implementations, the marine outboard engine includes a third lubricant conduit fluidly connecting the lubricant reservoir to the wristpin for supplying lubricant from the lubricant reservoir to the wristpin.

In some implementations, the marine outboard engine includes a crankpin operatively connecting the connecting rod to the crankshaft, the first conduit supplying lubricant from the lubricant reservoir to the crankpin.

In some implementations, the marine outboard engine includes a third lubricant conduit fluidly connecting the gearcase chamber to the lubricant reservoir for returning lubricant from the gearcase chamber to the lubricant reservoir.

In some implementations, the marine outboard engine includes a third lubricant conduit fluidly connecting the gearcase chamber to the internal combustion engine for supplying lubricant from the gearcase chamber to the internal combustion engine.

In some implementations, the internal combustion engine includes a rotating component being rotationally mounted to the crankcase and operatively connected to the crankshaft to be driven by the crankshaft, the rotating component supplying lubricant from the third lubricant conduit to at least one other component of the internal combustion engine.

In some implementations, the internal combustion engine includes an auxiliary bearing disposed outside of the crankcase chamber, and the at least one other component of the internal combustion engine is the auxiliary bearing.

In some implementations, the marine outboard engine includes a fourth lubricant conduit fluidly connecting an outer surface of the rotating component to the lubricant reservoir for supplying lubricant from the third fluid conduit to the lubricant reservoir.

In some implementations, the outer surface of the rotating component defines a centrifugal impeller for centrifugally pumping lubricant from the third lubricant conduit to the auxiliary bearing.

In some implementations, the centrifugal impeller is disposed below the top of the lubricant reservoir.

In some implementations, the centrifugal impeller is disposed below a bottom of the lubricant reservoir.

These examples are non-limiting.

For purposes of this application, terms related to spatial orientation such as forward, rearward, upward, downward, left, and right, should be understood in a frame of reference where the propeller position corresponds to a rear of the marine outboard engine. Terms related to spatial orientation when describing or referring to components or sub-assemblies of the engine separately from the engine should be understood as they would be understood when these components or sub-assemblies are mounted to the engine, unless specified otherwise in this application.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present technology will be described with reference to its use in a marine outboard engine 100 used to propel a watercraft.

Figure 1:
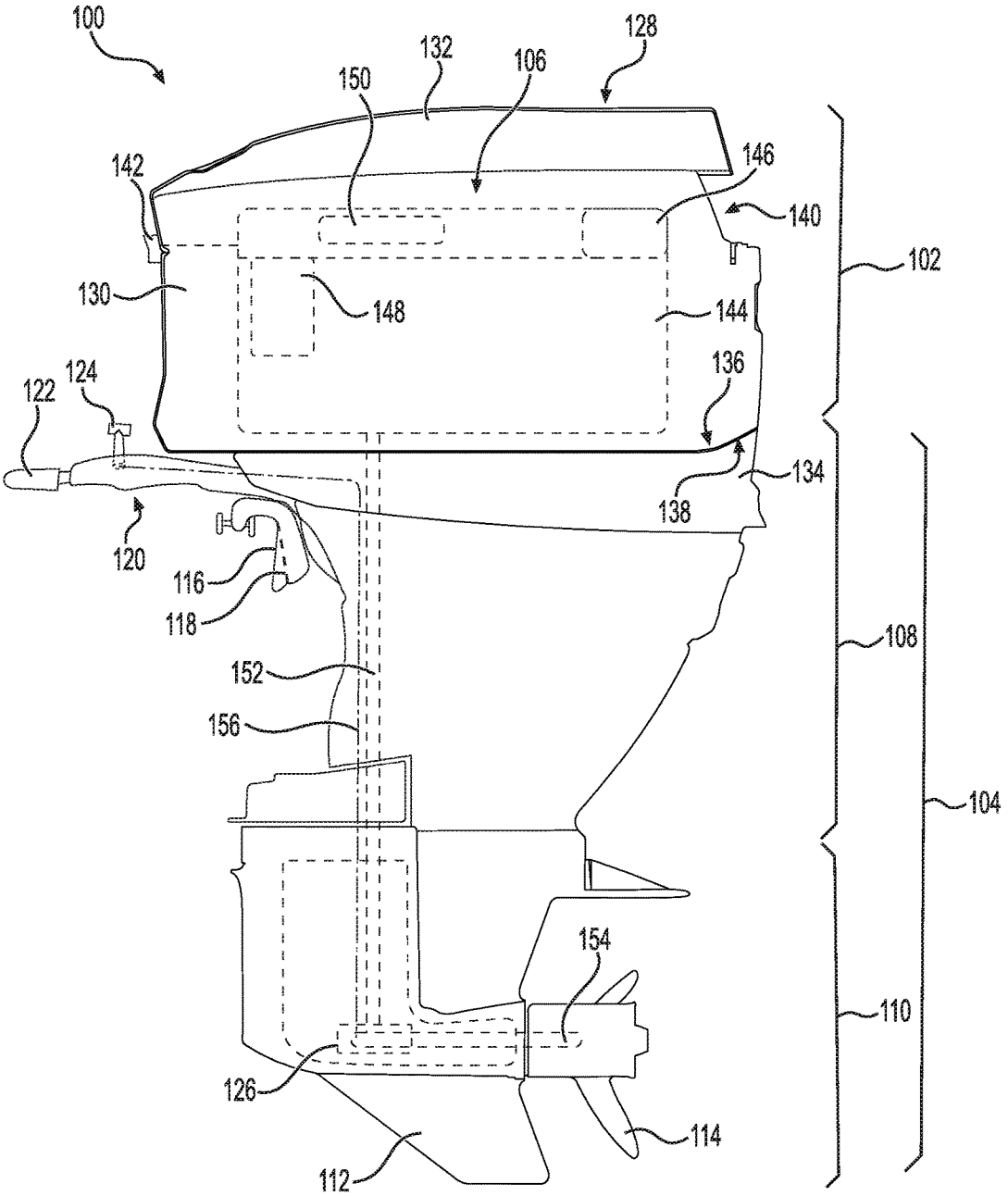
FIG. 1 is a left side elevation view of a marine outboard engine.

With reference to FIG. 1, the marine outboard engine 100 includes a top portion 102 and a bottom portion 104. The top portion 102 includes an engine assembly 106 for powering the marine outboard engine 100. The bottom portion 104 includes a mid-section 108, a gearcase 110, a skeg portion 112 and a propeller 114.

A stern bracket 116 and a swivel bracket 118 (shown schematically in FIG. 1) are used to mount the marine outboard engine 100 to a watercraft. The stern bracket 116 is attachable to a watercraft and can take various forms, the details of which are conventionally known. The swivel bracket 118 pivotally connects to the stern bracket 116 to allow for changes in the tilt/trim of the marine outboard engine 100. The mid-section 108 pivotally connects to the swivel bracket 118 to allow for steering of the marine outboard engine 100. It is contemplated that any other mechanism could be used for mounting the marine outboard engine 100 onto a watercraft.

In the implementation shown in FIG. 1, a tiller 120 is operatively connected to the swivel bracket 118 and extends forward of the engine assembly 106 to provide a lever used for manually steering of the marine outboard engine 100. The tiller 120 is rotationally fastened to the swivel bracket 118 such that it can be raised for ease of handling and transportation. The tiller 120 includes a handle 122 in the form of a twist grip used as throttle control as in most conventional small marine outboard engines.

The tiller 120 also includes a shift lever 124 for selecting a forward or reverse gear of a transmission 126 of the marine outboard engine 100 or setting the transmission 126 into neutral. It is contemplated that the tiller 120 could be any other tiller. It is also contemplated that the tiller 120 could be omitted and that the marine outboard engine 100 could be steered using a steering wheel connected to a cable, hydraulic, electric or a combination steering system and the throttle of the marine outboard engine 100 and that the position of the transmission 126 could be controlled by one or more levers disposed near the steering wheel.

The marine outboard engine 100 has a cowling 128. The cowling 128 surrounds and protects the engine assembly 106 housed within the cowling 128. The cowling 128 includes an upper motor cover assembly 130 with a top cap 132, and a lower motor cover 134. The upper motor cover assembly 130 encloses a top portion of the engine assembly 106. The lower motor cover 134 surrounds the remainder of the engine assembly 106 and a part of an exhaust system of the marine outboard engine 100. The mid-section 108 extends downward from the engine assembly 106 to the gearcase 110 and includes a lower half of the lower motor cover 134.

The upper motor cover assembly 130 and the lower motor cover 134 are made of sheet material, such as plastic, but could also be made of metal, composite or the like. The lower motor cover 134 and/or other components of the cowling 128 can be formed as a single piece or as several pieces. For example, the lower motor cover 134 can be formed as two lateral pieces mating along a vertical joint. The lower motor cover 134 is also made of sheet material, such as plastic, but could also be made of metal, composites or the like. One suitable composite is a sheet molding compound (SMC) which is typically a fiberglass reinforced sheet molded to shape.

As shown in FIG. 1, a lower edge 136 of the upper motor cover assembly 130 mates in a sealing relationship with an upper edge 138 of the lower motor cover 134. The upper motor cover assembly 130 is formed in two parts, but could also be a single part. A seal (not shown) is disposed between the lower edge 136 of the upper motor cover assembly 130 and the upper edge 138 of the lower motor cover 134 to form a watertight connection. One or more locking mechanisms (not shown) are provided on at least one of the sides and/or at the front and/or back of the cowling 128 to lock the upper motor cover assembly 130 onto the lower motor cover 134.

The upper motor cover assembly 130 includes an air intake portion 140 formed as a recessed portion on the rear of the cowling 128. The air intake portion 140 is configured to allow the entry of air but prevent the entry water into the interior of the cowling 128 and then into the engine assembly 106. Such a configuration can include a tortuous path for example.

The top cap 132 defines a portion of the air intake portion 140. It is contemplated that the air intake portion 140 could be defined elsewhere on the cowling 128. The top cap 132 also defines an aperture (not shown) against which a handle 142 of a manual start assembly (not shown) is received. More specifically, the manual start assembly is a rope-pull start assembly and will not be described herein in detail. It is contemplated that the marine outboard engine 100 could have an electric start assembly (not shown) in addition to or in substitution of the manual start assembly.

Figure 4:
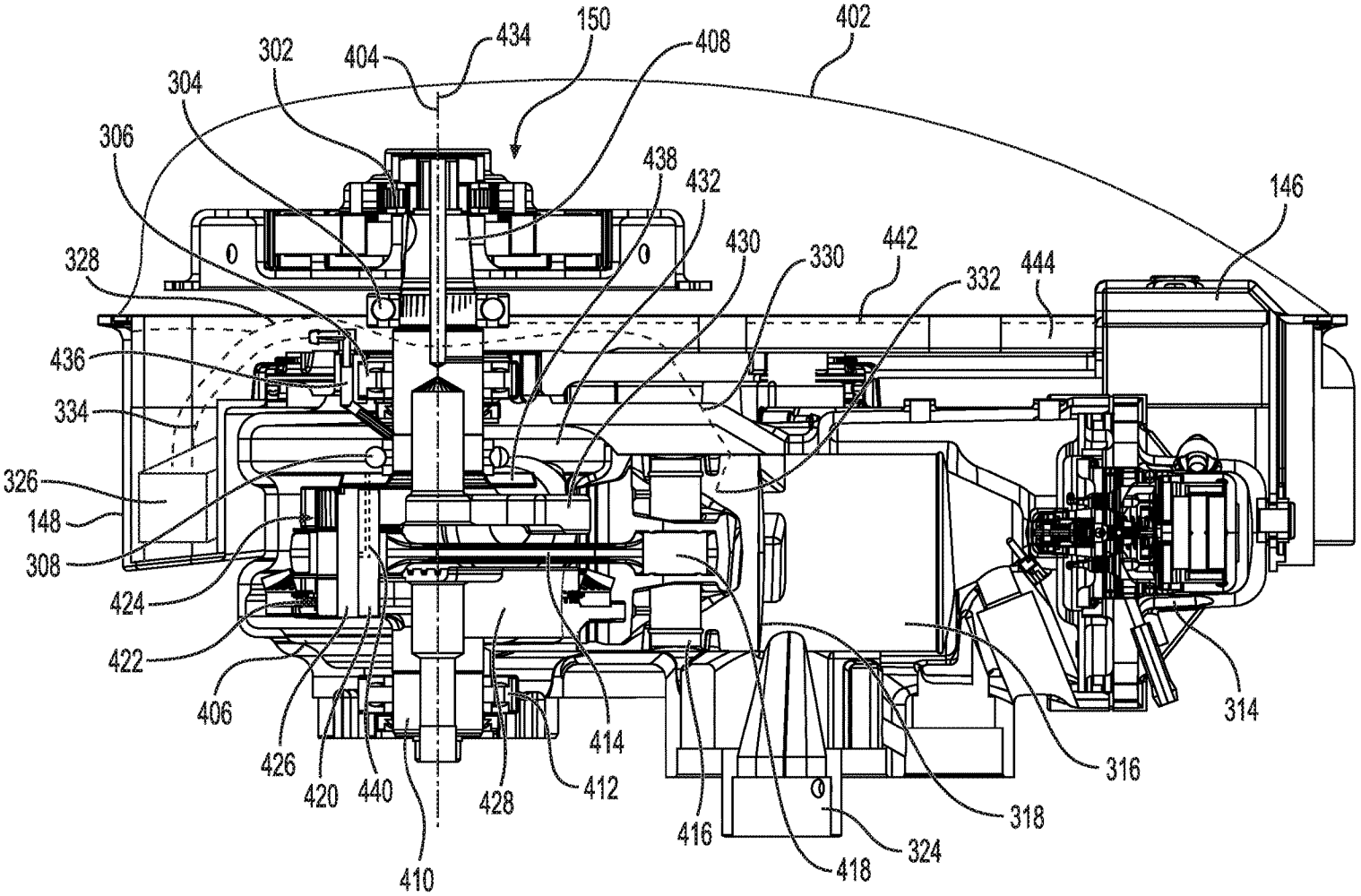
FIG. 4 is a cross-sectional view of an engine assembly of the marine outboard engine of FIG. 1, taken along line 3-3 of FIG. 2A.

As schematically shown in FIG. 1, the engine assembly 106 includes an internal combustion engine 144, a coolant tank 146 for holding coolant, a lubricant reservoir 148 for holding lubricant and a magneto 150. As schematically shown in FIG. 4, an engine cover 402 is mounted to the internal combustion engine 144 and is disposed in the cowling 128. It is contemplated that the upper motor cover assembly 130 and the lower motor cover 134 could be omitted such that the engine cover 402 is exposed. It is contemplated that the engine cover 402 could be omitted.

The engine cover 402 encloses the manual start assembly, the coolant tank 146 and the magneto 150. The coolant tank 146 contains coolant for cooling the internal combustion engine 144 via a conventionally known coolant flow circuit (not shown). It is contemplated that any other cooling system, such as a cooling system that uses water in which the marine outboard engine 100 is used, could be used for cooling the internal combustion engine 144.

Turning now to FIGS. 2B to 4, the magneto 150 includes a stator 202 and a flywheel 204. The stator 202 includes a number of field coils 206 (only one of which is labeled for clarity) arranged radially about a center of a central ring 208. The central ring 208 is mounted to the internal combustion engine 144 such that the central ring 208 (and consequently the field coils 206) is stationary relative to the internal combustion engine 144.

The flywheel 204 includes number of magnets 210 (only one of which is labeled for clarity) connected to an inner surface (FIG. 2B) of the flywheel 204 so as to be disposed radially between the inner surface of the flywheel 204 and the field coils 206. The flywheel 204 is mounted concentrically onto a top end of a crankshaft 212 of the internal combustion engine 144, and is driven by the crankshaft 212.

A bearing 302 (FIG. 3) rotationally mounts the stator 202 to the crankshaft 212. As the crankshaft 212 drives the flywheel 204, the magnets 210 of the flywheel 204 move around the field coils 206 of the stator 202. The magneto 150 thereby generates electricity and powers electrical components of the marine outboard engine 100. It is contemplated that the magneto 150 could be any suitable magneto. It is also contemplated that the magneto 150 could be replaced with an alternative system for generating electricity, such as an alternator.

Figure 2A:
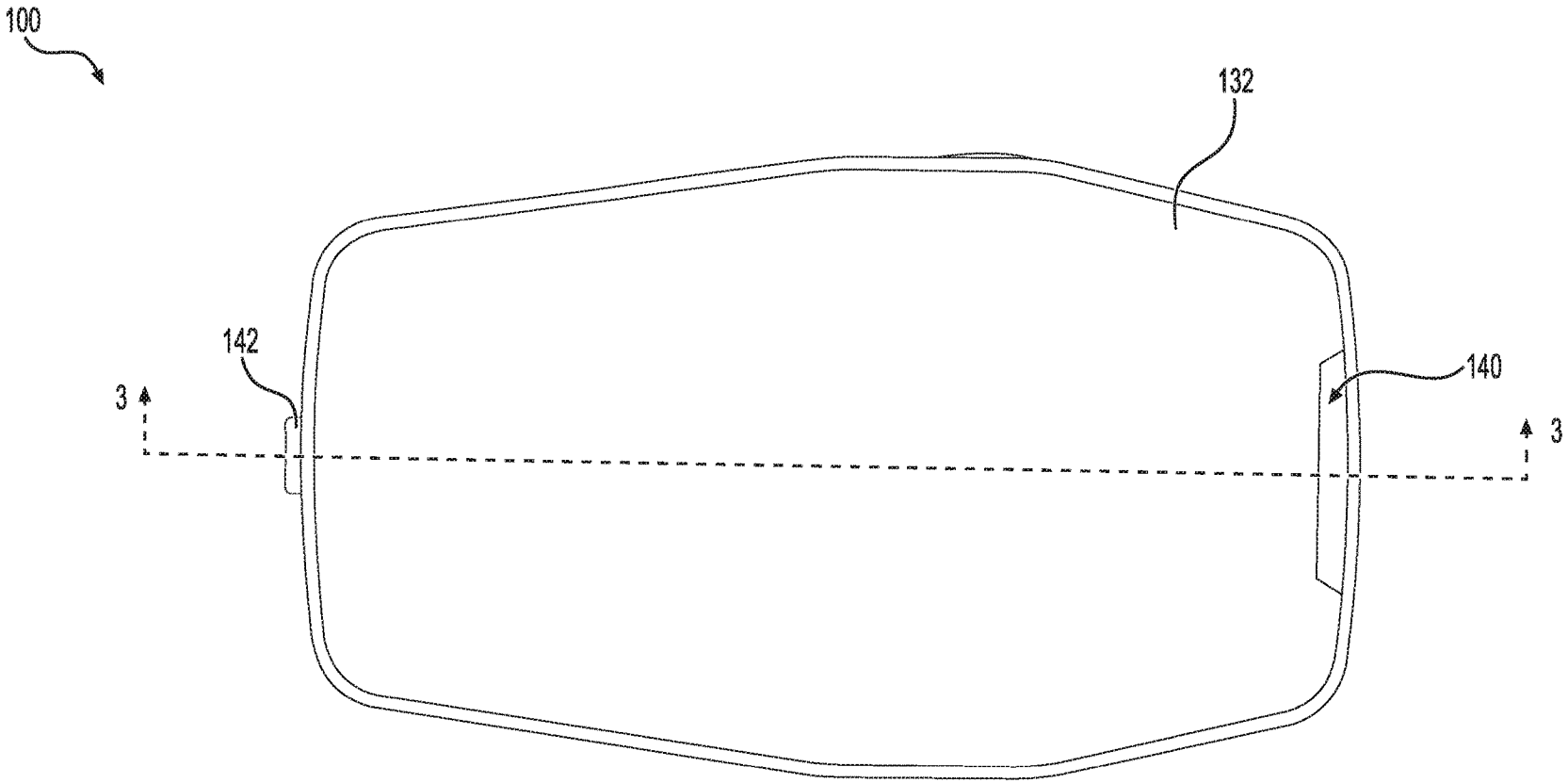
FIG. 2A is a top plan view of the marine outboard engine of FIG. 1.
Figure 2B:
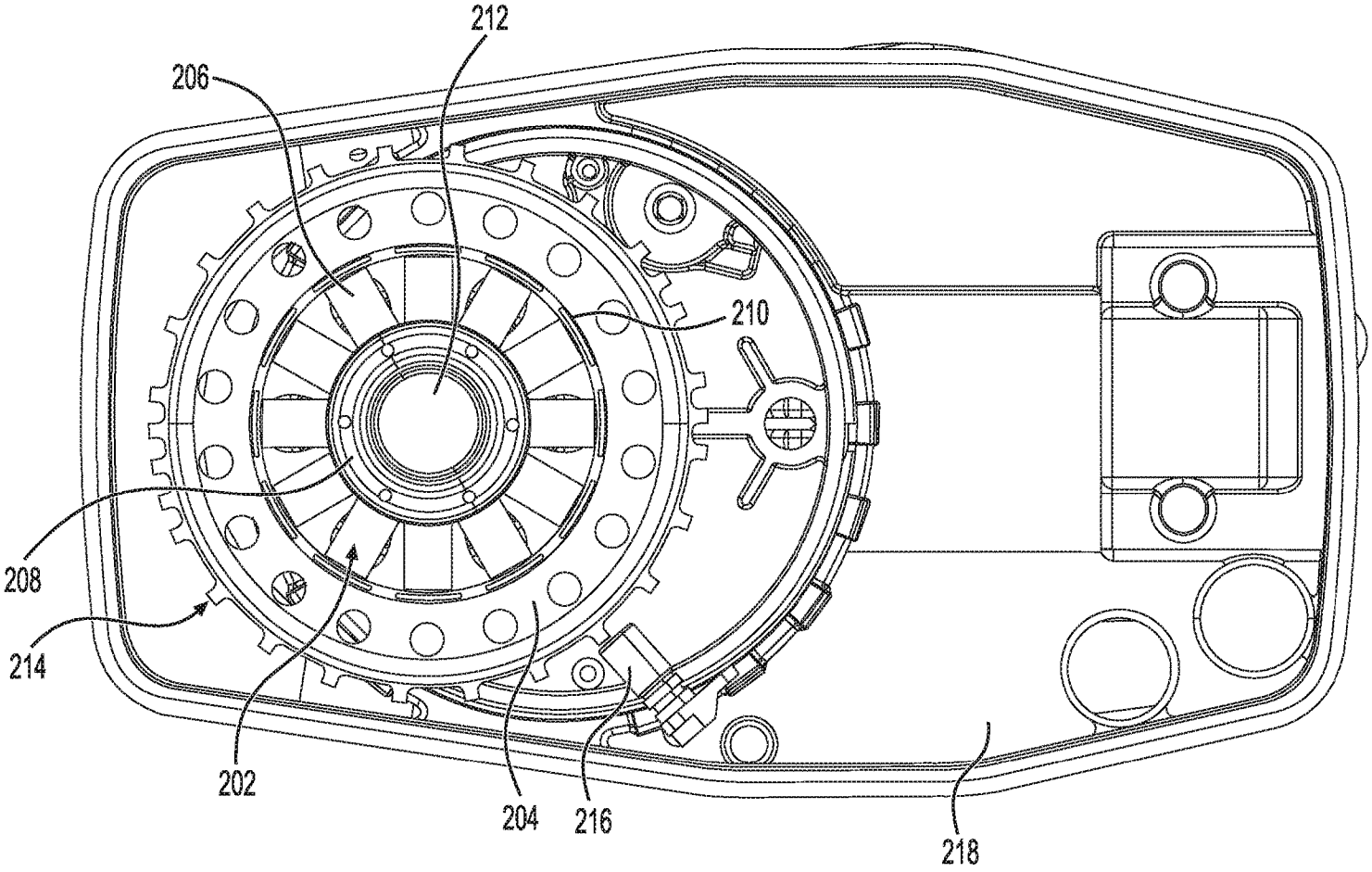
FIG. 2B is a top plan view of the marine outboard engine of FIG. 1 with a top cap and engine cover removed.

As shown in FIG. 2B, the flywheel 204 also includes ring of teeth 214 disposed about a periphery of the flywheel 204. The ring of teeth 214 is arranged in a pattern of teeth. A crankshaft position sensor 216, that, inter alia, is used to determine engine rotation speed (in rotations per minute, "RPM"), is mounted to an intermediate cover 218 of the engine assembly 106, senses the pattern of teeth of the ring of teeth 214 as the flywheel 204 rotates and thereby generates a signal representative of a position of the crankshaft 212. It is contemplated that the marine outboard engine 100 could have various other types of crankshaft sensors.

Figure 3:
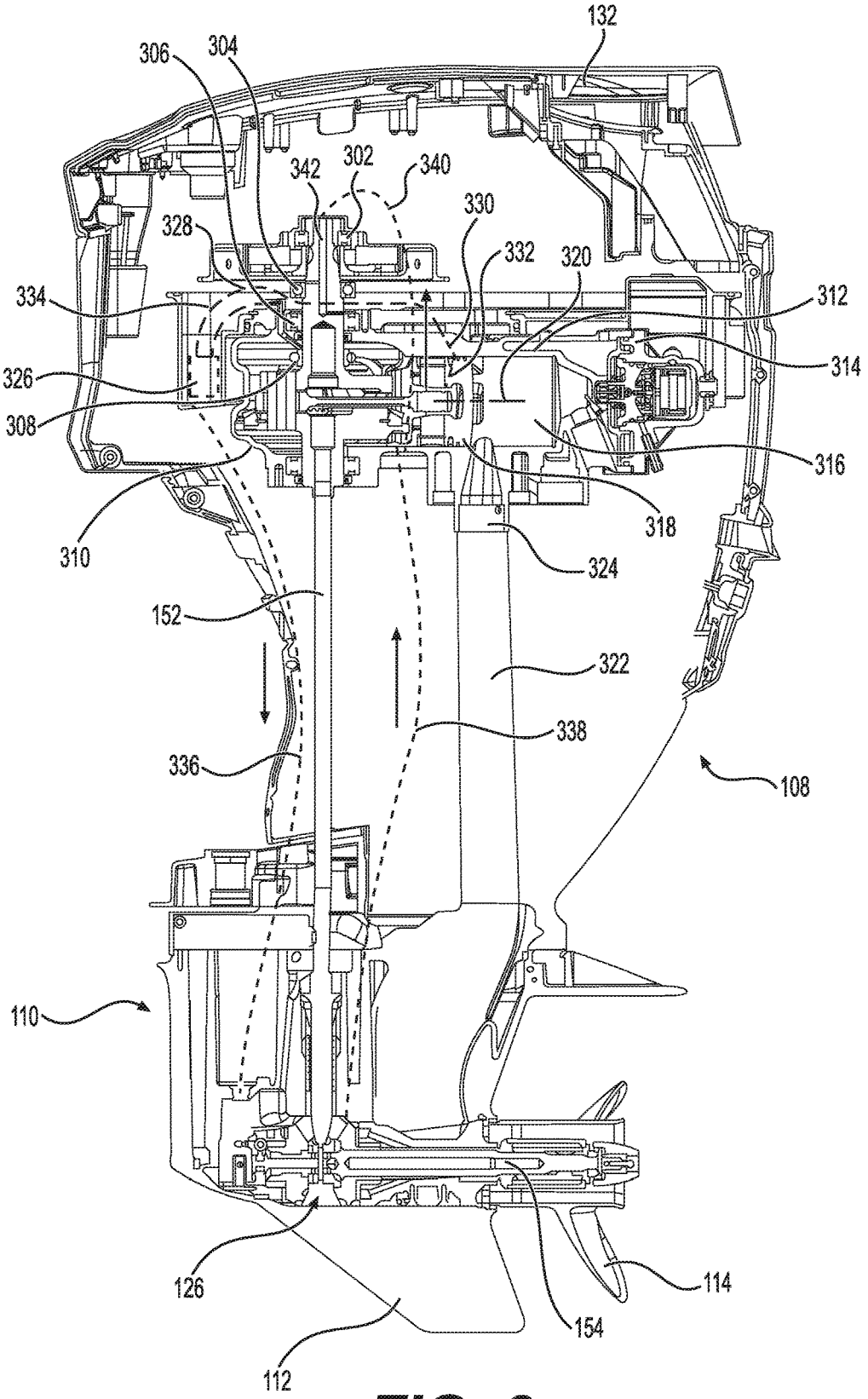
FIG. 3 is a cross-sectional view of the marine outboard engine of FIG. 1, taken along line 3-3 of FIG. 2A, with some parts removed.
Figure 5:
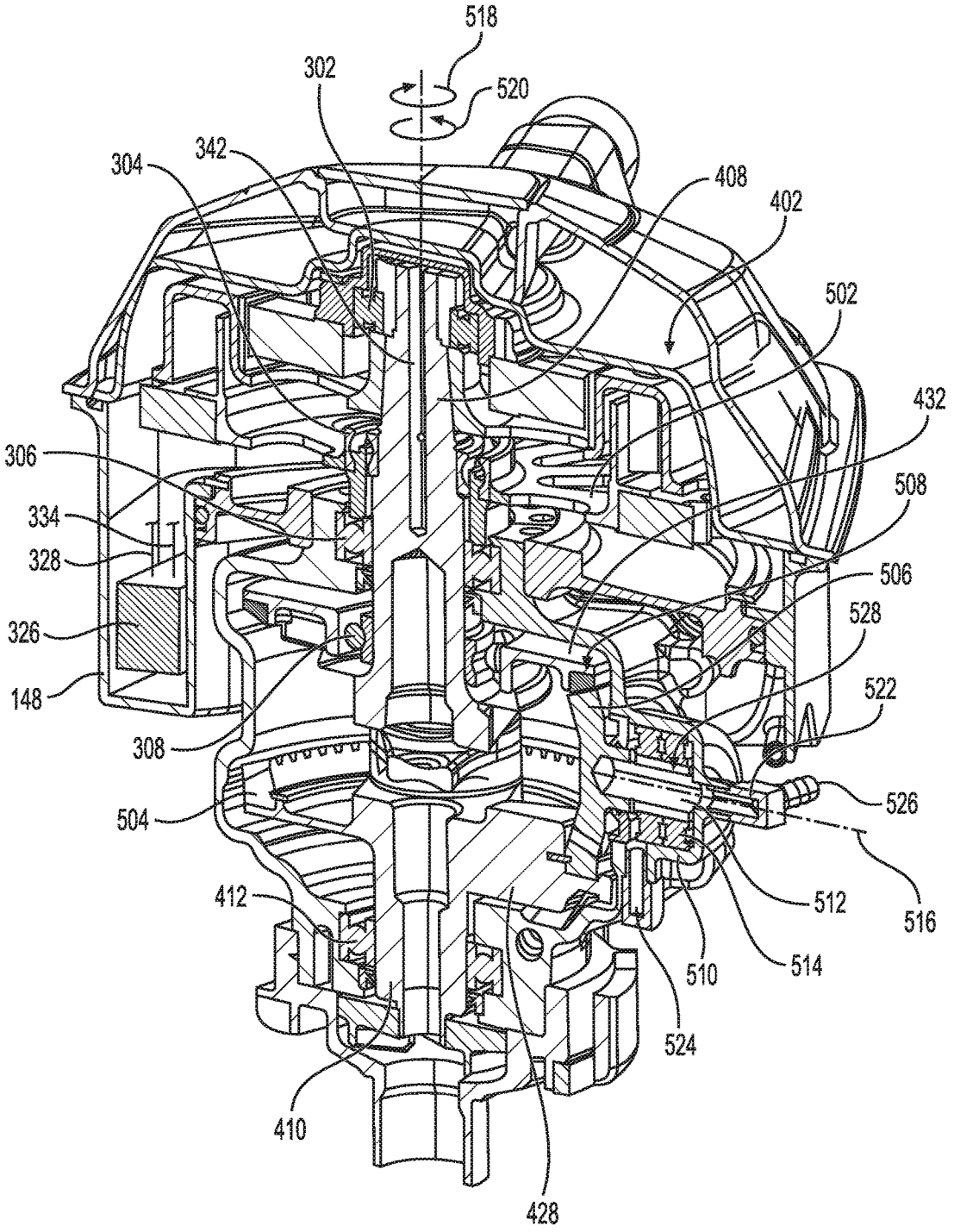
FIG. 5 is a perspective cross-sectional view of a top portion of the engine assembly of FIG. 4, taken along a plane passing through a center of a crankshaft and a center of a shaft of a gear that acts as a lubricant pump of the marine outboard engine.

Turning now briefly to FIGS. 3 and 5, in the present implementation, the engine assembly 106 includes a clutch 502 that is rotationally supported on the crankshaft 212 by a bearing 304. The clutch 502 selectively connects the manual start assembly to the flywheel 204 for starting the internal combustion engine 144. It is contemplated that the clutch 502 and the bearing 304 could be omitted and that a different manual start assembly could be used.

Returning now to FIGS. 3 and 4, the internal combustion engine 144 will be described in more detail. The internal combustion engine 144 is a two-stroke, direct injected internal combustion engine. It is contemplated that other types of engines, such as crankshaft engines for example, could be used.

The internal combustion engine 144 includes a crankcase 310, a cylinder block 312 and a cylinder head 314. In the present implementation, the crankcase 310, the cylinder block 312 and the cylinder head 314 are formed by two metal castings that are split along a crankshaft axis 404 (described below). One of the two castings forms a first half of the crankcase 310, and the cylinder block 312 and the cylinder head 314. The other of the two castings forms the other half of the crankcase 310. It is contemplated that a different construction could be used.

The crankcase 310 defines a crankcase chamber 406. The cylinder block 312 defines a cylinder 316. A piston 318 is disposed in the cylinder 316 and reciprocates in the cylinder 316 about a cylinder axis 320. It is contemplated that the cylinder block 312 could define more than one cylinder 316, in which case a corresponding number of pistons 318 would be provided. The cylinder head 314 is at the end of the cylinder block 312 opposite the crankcase 310 and includes a direct injector that injects fuel from an external fuel tank (not shown) into the cylinder 316. The direct injector is powered by the magneto 150 via an Electronic Control Unit ("ECU") 902 of the marine outboard engine 100. The ECU 902 is described later in this document.

As best shown in FIG. 4, the crankshaft 212 of the internal combustion engine 144 is housed in part in the crankcase chamber 406 and rotates about a crankshaft axis 404. The crankshaft 212 includes an upper output shaft 408 and a lower output shaft 410. The upper output shaft 408 extends upward out of the crankcase chamber 406 toward the magneto 150 and is rotationally supported by bearing 306.

The bearing 306 is disposed radially between the upper output shaft 408 and the crankcase 310. The lower output shaft 410 is rotationally supported by a bearing 412 and extends downward out of the crankcase chamber 406. The bearing 412 is disposed radially between the lower output shaft 410 and a lower portion of the crankcase 310. It is contemplated that the crankshaft 212 could be rotationally supported by a different number and combination of bearings.

Still referring to FIG. 4, the piston 318 is operatively connected to the upper and lower output shafts 408, 410 by a connecting rod 414. The piston 318 is connected at one end of the connecting rod 414 by a wristpin 416 received in an aperture defined in the one end of the connecting rod 414. The wristpin 416 includes a wristpin bearing 418 that allows the piston 318 to pivot with respect to the connecting rod 414.

At its other end, the connecting rod 414 is connected to the upper output shaft 408 and the lower output shaft 410 via a crankpin 420. More particularly, the crankpin 420 is received in an aperture defined in the other end of the connecting rod 414 and in two apertures 422, 424 defined in corresponding ones of the upper and lower output shafts 408, 410. The crankpin 420 includes a crankpin bearing 426 that allows the connecting rod 414 to pivot with respect to the crankshaft 212.

It is contemplated that the crankpin 420 could be integrally formed with the upper output shaft 408 or the lower output shaft 410. It is also contemplated that the crankpin 420 could be integrally formed with both the upper output shaft 408 and the lower output shaft 410 in order to have a unitary crankshaft, in which case the connecting rod 414 would be split in at least two parts through the aperture defined in the other end of the connecting rod 414 to permit attachment of the connecting rod 414 to the crankpin 420.

The lower output shaft 410 includes a crank disk 428 which is integrally formed with the lower output shaft 410. The aperture 422 is defined in the crank disk 428. Thus, the crankpin 420 engages and drives the crank disk 428 (and therefore the lower output shaft 410). The crank disk 428 has an eccentric mass distribution and counterbalances some of the vibrational forces generated by the operation of the internal combustion engine 144.

The upper output shaft 408 includes a counterweight 430 which is integrally formed with the upper output shaft 408. The aperture 424 is defined in the counterweight 430. Thus, the crankpin 420 also engages and drives the counterweight 430 (and therefore the upper output shaft 408). The counterweight 430 has an eccentric mass distribution and counterbalances some of the vibrational forces generated by the operation of the internal combustion engine 144. As shown in FIGS. 4 and 5, the counterweight 430 and the crank disk 428 are located on opposite sides of the connecting rod 414 and are aligned with each other.

Referring to FIGS. 4 and 5, the internal combustion engine 144 has yet another counterweight 432 disposed in the crankcase chamber 406. The counterweight 432 has an eccentric mass distribution and is disposed above the counterweight 430. The counterweight 432 works in concert with the counterweight 430 and the crank disk 428 in counterbalancing some of the vibrational forces generated by the operation of the internal combustion engine 144.

The counterweight 432 defines a central aperture and is rotationally mounted over the upper output shaft 408 by a bearing 308 disposed in the central aperture of the counterweight 432 radially between the upper output shaft 408 and the counterweight 432. Thus, the counterweight 432 rotates about a counterweight axis 434 that is coaxial with the crankshaft axis 404. In other words, the counterweight 432 rotates concentrically with the crankshaft 212.

The counterweight 432 is driven by the crankshaft 212 to rotate at the same speed as the crankshaft 212 but in the opposite direction than the crankshaft 212. In the present implementation, this is achieved by gears 504, 506, 508 (FIG. 5). It is contemplated that the counterweight 432 could be driven by the crankshaft 212 via other mechanisms such as, but not limited to, friction wheels and bets and pulleys.

Turning to FIG. 5, the gear 504 is an annular bevel gear. The gear 504 is mounted to an upper face of the crank disk 428 concentrically with the crankshaft 212, and is therefore coaxial with the counterweight axis 434 and the crankshaft axis 404. The crank disk 428 rotates the gear 504 about the counterweight axis 434 and the crankshaft axis 404 in the direction indicated by arrow 160 (FIG. 4).

The gear 506 is an idler gear, and more particularly a pinion 506. The pinion 506 engages the gears 504 and 508. As best shown in FIG. 5, the crankcase 310 defines a recess 510 therein and the gear 506 is disposed in part in the recess 510. More particularly, the gear 506 has a shaft 512 that is rotationally supported in the recess 510 by two bearings 514. It is contemplated that the shaft 512 could be supported by a different number and combination of bearings.

The gear 506 rotates about a pinion axis 516 that is normal to the crankshaft axis 404 and angled relative to a plane containing the cylinder axis 320 and the crankshaft axis 404. The gear 504 drives the gear 506, which in turn drives the gear 508 in a direction opposite to the gear 506. It is contemplated that more than one idler gear could be provided between the gears 504 and 508.

Still referring to FIG. 5, the gear 508 is an annular bevel gear. The gear 508 is mounted to a lower face of the counterweight 432 concentrically with the crankshaft 212, and is therefore coaxial with the counterweight axis 434 and the crankshaft axis 404. As described above, the gear 508 is engaged by the pinion 506. The gear 508 has the same diameter and the same number of teeth as the gear 504. As a result, the gear 508 rotates about the counterweight axis 434 at the same speed as the gear 504, but in a direction 518 opposite to the direction 520 of rotation of the gear 504.

The crank disk 428, the counterweights 428, 430 and the gears 504, 506, 508 are a counterbalancing system of the engine assembly 106. A similar counterbalancing system is described in more detail in commonly owned U.S. Provisional Patent Application No. 62/381,699, filed Aug. 31, 2016, entitled "INTERNAL COMBUSTION ENGINE", which application is hereby incorporated by reference herein in its entirety. It is contemplated that the counterbalancing system of the engine assembly 106 could be omitted or replaced with a balance shaft.

It is further contemplated that the marine outboard engine 100 could have any other counterbalancing system in place of or in addition to that described herein. For example, in some implementations, the marine outboard engine 100 could have a secondary flywheel similar to the one described in commonly owned U.S. Provisional Patent Application No. 62/381,696, filed Aug. 31, 2016, entitled "INTERNAL COMBUSTION ENGINE ASSEMBLY HAVING A FLYWHEEL", which application is hereby incorporated by reference herein in its entirety.

Now returning to FIG. 3, the mid-section 108 of the marine outboard engine 100 will be described in more detail.

The mid-section 108 connects the engine assembly 106 to the gearcase 110. A driveshaft 152 is coupled to a bottom end of the lower output shaft 410 and extends downward from the bottom end of the lower output shaft 410 through the mid-section 108 and into the gearcase 110. The mid-section 108 includes an exhaust conduit 322 that connects an exhaust port 324 of the internal combustion engine 144 to a gearcase exhaust passage (not shown) defined in the gearcase 110. The gearcase exhaust passage directs exhaust from the exhaust conduit 322 to a volume around a propeller shaft 154 of the marine outboard engine 100 and out through the propeller hub of the propeller 114. It is contemplated that any other suitable exhaust system could be used.

Now turning to FIG. 6, the gearcase 110 will be described in more detail.

The gearcase 110 defines a gearcase chamber 602. As will be described in more detail below, the gearcase chamber 602 contains lubricant. To this end, seals (not shown) are provided to fluidly seal the gearcase chamber 602 from water in which the marine outboard engine 100 will be used.

The driveshaft 152 is rotationally supported in the gearcase chamber 602 via bearings 604, 606 disposed in the gearcase chamber 602 and is rotatable about the crankshaft axis 404. The propeller shaft 154 is rotationally supported in the gearcase chamber 602 via bearings 608, 610, 612 disposed in the gearcase chamber 602. The propeller shaft 154 rotates about a propeller shaft axis 614 that is generally perpendicular to the crankshaft axis 404. The propeller shaft 154 extends rearward out of a rear end of the gearcase chamber 602.

The propeller 114 is mounted on a rear end of the propeller shaft 154 to be driven by the propeller shaft 154 for propelling the watercraft to which the marine outboard engine 100 will be mounted. The propeller 114 is an example of a marine rotor. It is contemplated the marine outboard engine 100 could have other marine rotors, such as, but not limited to, a jet propulsion impeller, or a turbine.

Figure 6:
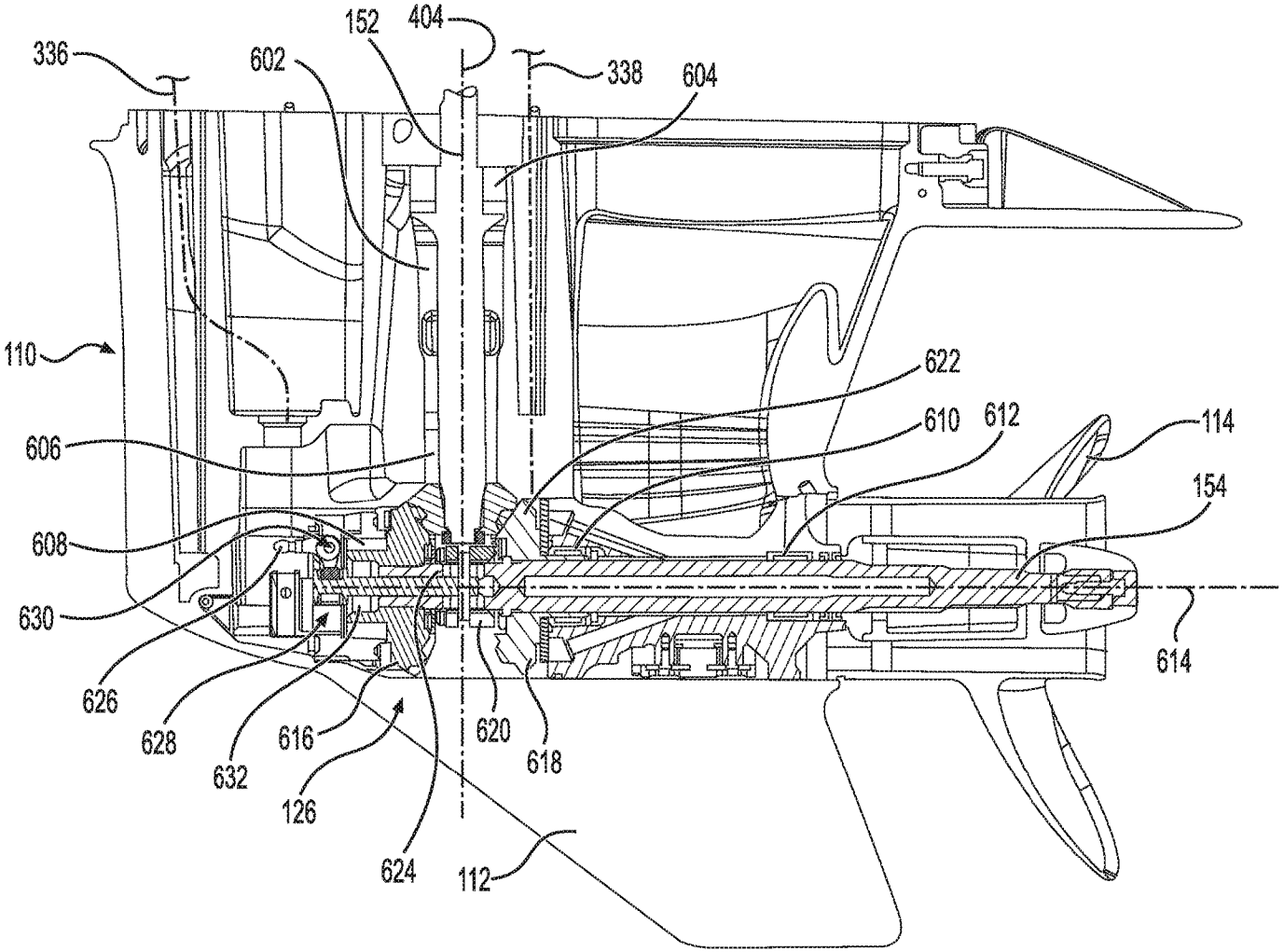
FIG. 6 is a cross-sectional view of a gearcase and propeller of the marine outboard engine of FIG. 1, taken along line 3-3 of FIG. 2A, with some parts removed.

Still referring to FIG. 6, and as mentioned at the beginning of this description, the marine outboard engine 100 includes a transmission 126 for transmitting power from the driveshaft 152 to the propeller 114. In the present implementation, the transmission 126 is a mechanical outboard transmission. It is also contemplated that the marine outboard engine 100 could have any other transmission.

The transmission 126 includes a forward bevel gear 616, a reverse bevel gear 618, and a dog clutch 620 disposed in the gearcase chamber 602. The forward bevel gear 616 and the reverse bevel gear 618 are mounted over the propeller shaft 154 concentrically with the propeller shaft 154 such that, unless engaged by the dog clutch 620, the forward bevel gear 616 and the reverse bevel gear 618 rotate independent of the propeller shaft 154.

A pinion gear 622 is connected to a bottom end of the driveshaft 152 and is in engagement with the driveshaft 152. The pinion gear 622, in turn, is engaged with the forward bevel gear 616 and the reverse bevel gear 618 and thereby drives the forward bevel gear 616 and the reverse bevel gear 618 in opposite directions to each other.

In the present implementation, the forward bevel gear 616 rotates in the direction for propelling the marine outboard engine 100 forward. The reverse bevel gear 618 rotates in the direction for propelling the marine outboard engine 100 rearward. It is contemplated that, for example depending on the particular implementation of the propeller 114 used with the marine outboard engine 100, the gear 616 could be the reverse gear, and the gear 618 could be the forward gear.

Figure 7:
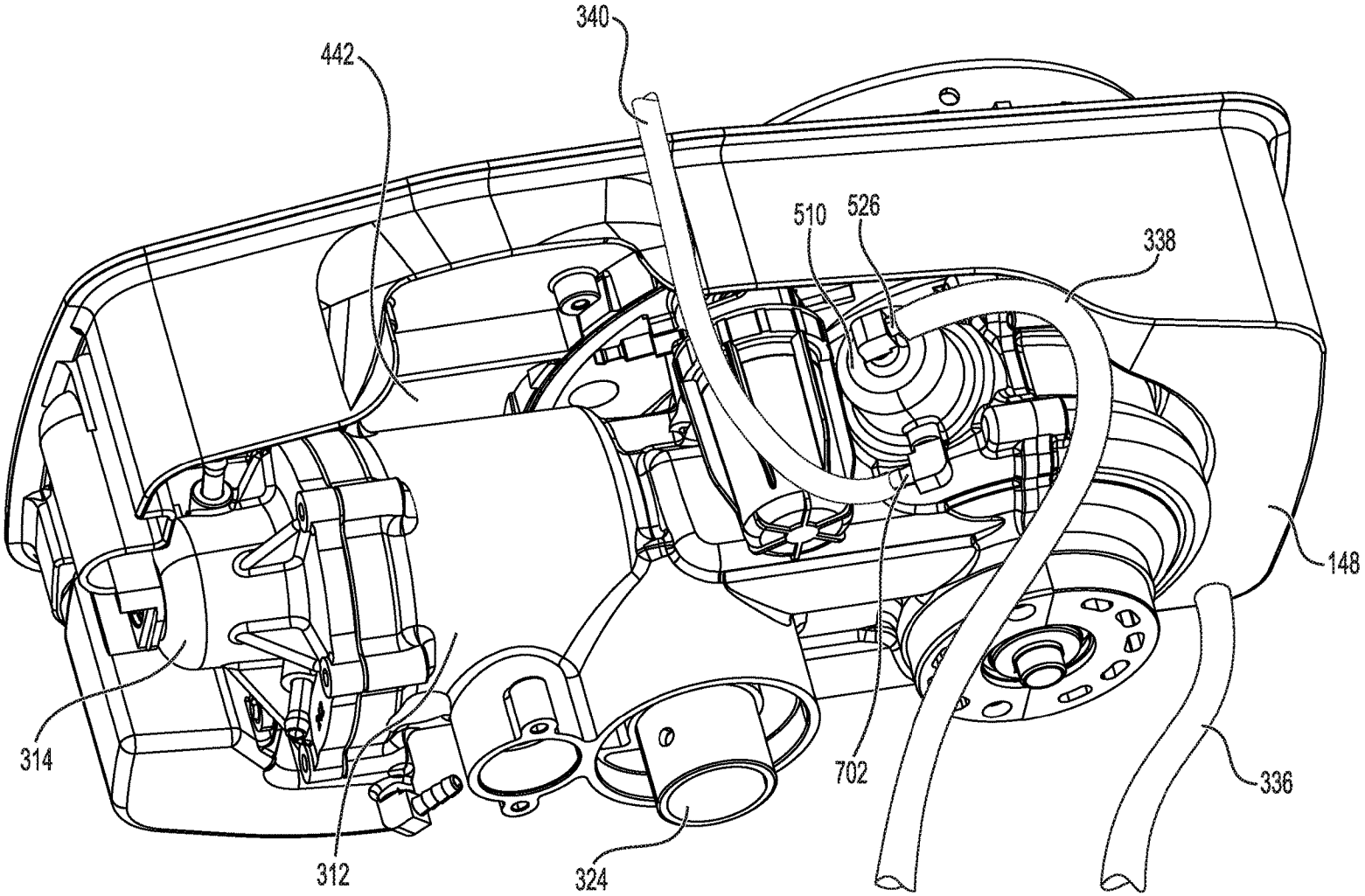
FIG. 7 is a perspective view taken from a bottom rear, right side of the engine assembly of FIG. 4, with an engine cover removed.

The dog clutch 620 is splined onto a splined portion 624 of the propeller shaft 154. In FIG. 7, the dog clutch 620 is in a neutral position. In this position, the bevel gears 616, 618 are decoupled from the propeller shaft 154 and thus transmit no power to the propeller shaft 154. From the neutral position, the dog clutch 620 is slidable to the forward bevel gear 616 to couple the forward bevel gear 616 to the propeller shaft 154 ("forward position") to propel the marine outboard engine 100 forward. Also from the neutral position, the dog clutch 620 is slidable to the reverse bevel gear 618 to couple the reverse bevel gear 618 to the propeller shaft 154 ("reverse position") to propel the marine outboard engine 100 rearward.

The dog clutch 620 is operatively connected to a pivot pin 626 via an actuating assembly 628 such that the dog clutch 620 is selectively slidable on the splined portion 624 of the propeller shaft 154 between the forward position, the reverse position and the neutral position by pivoting the pivot pin 626 about a pivot pin axis 630.

The pivot pin 626 is disposed in the gearcase 110 in front of the gearcase chamber 602 and is connected to the shift lever 124 (FIG. 1) of the tiller 120 of the marine outboard engine 100 via a conventionally known rod assembly 156 (FIG. 1). As shown in FIG. 1, the rod assembly 156 extends from the pivot pin 626, upward through the mid-section 108 and to the shift lever 124. To maintain clarity, the rod assembly 156 has been omitted from FIG. 7. The pivot pin 626 is pivotable about the pivot pin axis 630 via the rod assembly 156 by pivoting the shift lever 124 in a corresponding direction.

The actuating assembly 628 includes a push rod 632 that is coupled at its one end to the dog clutch 620 and at its other end to the pivot pin 626. The push rod 632 extends from the dog clutch 620 out of the gearcase chamber 602 and to the pivot pin 626. The push rod 632 is disposed in part in the propeller shaft 154 concentrically with the propeller shaft 154 and is slidable rearward and forward in the propeller shaft 154. Pivoting the shift lever 124 slides the push rod 632.

Sliding of the push rod 632 in corresponding directions slides the dog clutch 620 between the forward position, the reverse position and the neutral position. It is contemplated that the outboard engine could be provided with only forward and neutral gears, in which case the reverse bevel gear 618 would be omitted. It is further contemplated that the marine outboard engine 100 could be provided with only a forward gear, in which case the reverse bevel gear 618 and dog clutch 620 would be omitted.

Now turning to FIGS. 3, 4 and 8, a lubrication system of the marine outboard engine 100 will be described in more detail. As previously described, the marine outboard engine 100 includes a lubricant reservoir 148 for holding lubricant. In the present implementation, the lubricant reservoir 148 has a lubricant pump 326 disposed therein. It is contemplated that the lubricant pump 326 could be disposed outside of the lubricant reservoir 148 and/or outside of the engine cover 402.

The lubricant pump 326 has an inlet via which the lubricant pump 326 draws lubricant from the lubricant reservoir 148. In the present implementation, the lubricant pump 326 has two outlets via which the lubricant pump 326 supplies lubricant drawn in via the inlet. A wristpin supply hose 328 is connected to one outlet of the lubricant pump 326 at one end and at the other end to a lubricant conduit 330 (FIG. 4) defined through the cylinder block 312. The wristpin supply hose 328, and the other hoses that will be described herein, are examples of fluid conduits. It is contemplated that different, and/or additional conduits could be used. It is contemplated that the lubricant pump 326 could have a different number of inlets and/or outlets.

FIG. 4 shows the piston 318 at bottom dead center position. As best shown in FIG. 4, in this position, the wristpin supply hose 328 and the lubricant conduit 330 fluidly connect the lubricant pump 326 to supply lubricant to an outer surface of the piston 318 to provide lubrication between the outer surface of the piston 318 and the inner surface of the cylinder 316. A pair of grooves is defined in the outer surface of the piston 318 to help maintain lubrication between the outer surface of the piston 318 and the inner surface of the cylinder 316, but other features could also be used. Another lubricant conduit 332 is defined through the head of the piston 318 and supplies lubricant from the outer surface of the piston 318 to the wristpin 416 to lubricate the wristpin bearing 418.

Lubricant received by the wristpin 416 and the wristpin bearing 418 then flows to the cylinder 316. By nature of the two-stroke operating principal of the internal combustion engine 144, this lubricant is then gradually vaporized into air consumed by the internal combustion engine 144 with each combustion cycle of the internal combustion engine 144 and exhausted with the exhaust gas through the exhaust port 324. It is contemplated that lubricant could be provided to more than one point around the outer diameter of the piston 318 via one or more additional lubricant hose and/or lubricant conduit 330.

A crankpin supply hose 334 is connected to the other outlet of the lubricant pump 326 at one end and at the other end to another lubricant conduit 436 (FIG. 4) defined through the crankcase 310 in front of the crankshaft 212. The crankpin supply hose 334 is an example of a fluid conduit. It is contemplated that a different, and/or additional conduits could be used. The lubricant conduit 436 supplies lubricant from the lubricant reservoir 148 onto the bearing 308 (FIG. 4) and the upper output shaft 408.

Now turning to FIGS. 4 and 8, a scupper 438 is mounted concentrically over the upper output shaft 408 and disposed below the bearing 308 such that lubricant supplied onto the bearing 308 passes through (and lubricates) the bearing 308 and collects on the scupper 438. The scupper 438 defines an aperture that is disposed in the scupper 438 such that when the piston 318 is at bottom dead center, the aperture in the scupper 438 fluidly connects a top surface of the scupper 438 (on which lubricant is collected) to a lubricant conduit 440 defined in the crankpin 420.

Still referring to FIG. 4, the lubricant conduit 440 in the crankpin 420 extends to an outer surface of the crankpin 420 and, when the piston 318 is at bottom dead center, supplies lubricant from the aperture of the scupper 438 to the crankpin bearing 426 to lubricate the crankpin bearing 426.

Figure 8:
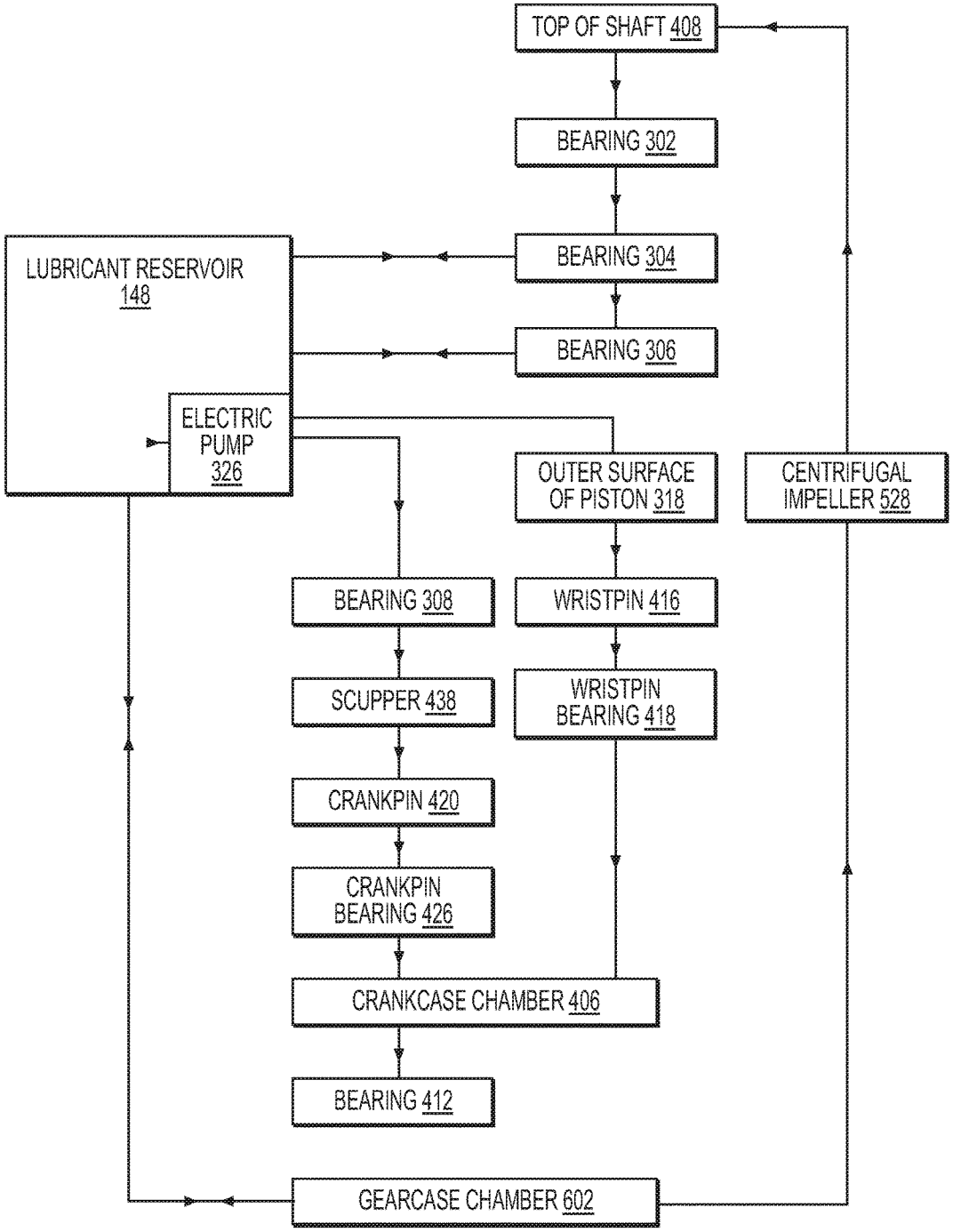
FIG. 8 is a schematic showing a simplified layout of lubrication connections of some components of the marine outboard engine of FIG. 1.

As shown schematically in FIG. 8, lubricant received by the crankpin bearing 426 passes through (and lubricates) the crankpin bearing 426 and flows downward along the lower output shaft 410 and into the crankcase chamber 406. Lubricant then flows from the crankcase chamber 406 downward into the bearing 412 to lubricate the bearing 412. By nature of the two-stroke operating principal of the internal combustion engine 144, lubricant in the crankcase chamber 406 is then gradually vaporized into air consumed by the internal combustion engine 144 with each combustion cycle of the internal combustion engine 144 and exhausted with the exhaust gas through the exhaust port 324.

Figure 9:
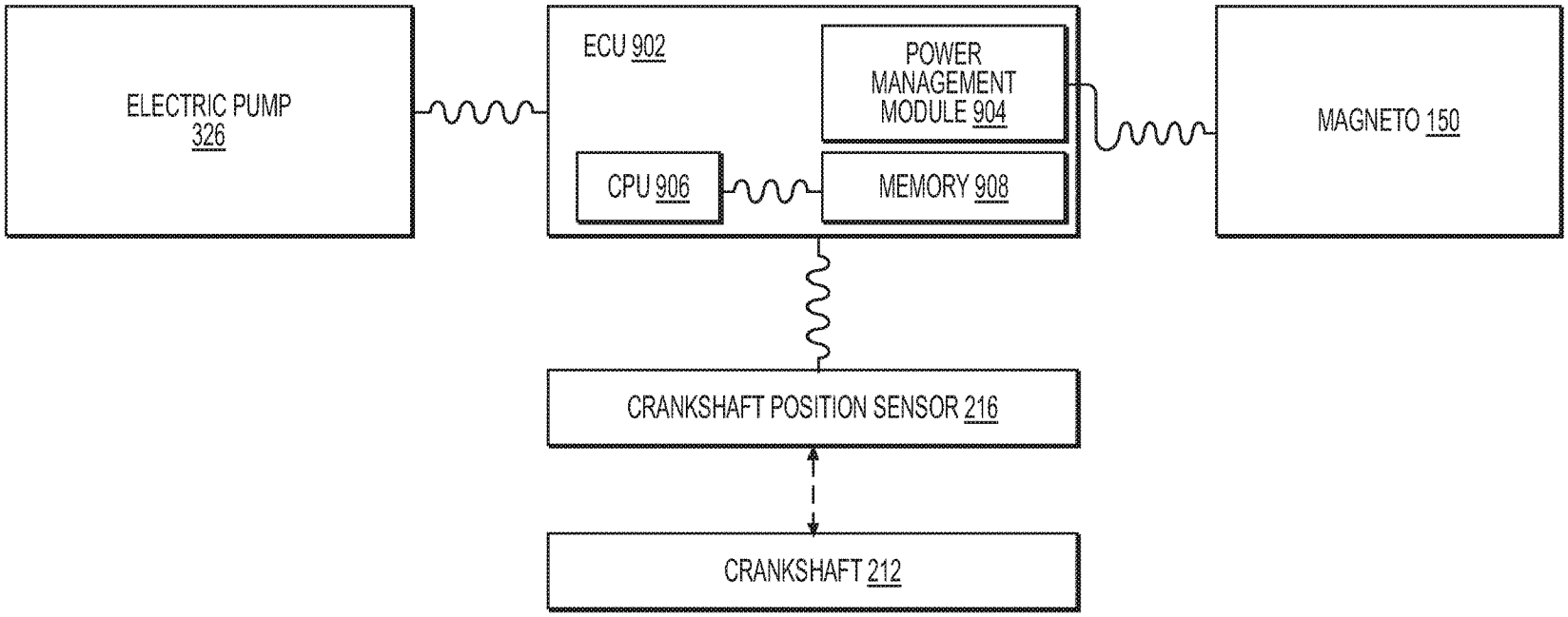
FIG. 9 is a schematic showing a simplified layout of electric connections of some electric components of the marine outboard engine of FIG. 1.

Now turning to FIG. 9, control of the lubricant pump 326 is implemented as follows.

In the present implementation, the lubricant pump 326 is electric and the marine outboard engine 100 includes the ECU 902 (described briefly herein above), also referred to as an engine management module ("EMM"), disposed beneath the cowling 128. The ECU 902 is in electronic communication with the crankshaft position sensor 216 and the lubricant pump 326. The ECU 902 controls the lubricant pump 326, and hence delivery of lubricant to components within the crankcase 310 and cylinder block 312, as a function of parameters such as the position of the crankshaft 212 and engine RPM.

The lubricant pump 326 and the crankshaft position sensor 216 are powered by the magneto 150 via the ECU 902. More particularly, the magneto 150 generates a power supply (in the present implementation, 20 amperes at 55 volts) that powers the ECU 902. A power management module 904 within the ECU then transforms this power supply into different voltages that are then distributed to the various electrical components of the marine outboard engine 100, including the lubricant pump 326 and the crankshaft position sensor 216.

An example of this type of electrical system is described in detail in commonly owned U.S. Pat. No. 9,004,961 B1, filed Dec. 18, 2012, entitled "Marine Outboard Engine Having an Auxiliary Battery Charging System", which patent is incorporated by reference herein in its entirety. Another example of this type of electrical system is described in detail in commonly owned U.S. Pat. No. 9,365,277 B2, filed. Jul. 23, 2014, entitled "Battery Connection System for an Outboard Engine", which patent is incorporated by reference herein in its entirety.

In the present implementation, the ECU 902 includes a processor 906 for carrying out executable code, a non-transitory memory module 908 that stores the executable code in a non-transitory medium (not shown) included in the memory module 908, and the power management module 904. The processor 906 executes the executable code stored in the memory module 908, and thereby causes the ECU 902 to control the lubricant pump 326 as described above.

It is contemplated that the marine outboard engine 100 could include additional sensors in electronic communication with the ECU 902 to read various additional operating parameters of the marine outboard engine 100. In such implementations, the ECU 902 would receive the various additional operating parameters from the additional sensors and would account for the operating parameters in controlling the lubricant pump 326 by using any suitable control algorithm. The control algorithm would be part of the executable code stored in the non-transitory medium of the memory module 908. It is contemplated that the marine outboard engine 100 could have a different control system for the lubricant pump 326.

Now turning to FIGS. 3, 4, 6, 7 and 8, another portion of the lubrication system will be described in more detail. As best shown in FIG. 3, a hose 336 fluidly connects a bottom of the lubricant reservoir 148 to a front end of the gearcase chamber 602. It is contemplated that the hose 336 could be received in a different part of the lubricant reservoir 148, such as a side of the lubricant reservoir 148. It is contemplated that the hose 336 could be received in a different part of the gearcase chamber 602, such as a top end or the rear end of the gearcase chamber 602. It is contemplated that additional hoses, and/or other conduits, could be used to fluidly connect the lubricant reservoir 148 to the gearcase chamber 602.

Over the use cycle of the marine outboard engine 100 (which use cycle includes the marine outboard engine 100 being hot when in use, and cold when not in use), some components of the marine outboard engine 100, including the internal combustion engine 144 and the gearcase 110, undergo variations in temperature and corresponding expansions and contractions resulting from the temperature variations. Some such variations and expansions and contractions induce movement of lubricant between the lubricant reservoir 148 and the gearcase chamber 602. More particularly, over the course of a season, lubricant will travel through the hose 336 both from the lubricant reservoir 148 to the gearcase chamber 602 and from the gearcase chamber 602 into the lubricant reservoir 148.

In the present implementation, the internal combustion engine 144 consumes lubricant during use. Therefore, over time, the internal combustion engine 144 will consume during use will be lubricant that was contained, at least at one point in time, in the gearcase chamber 602 and has since then returned to the lubricant reservoir 148. Also, as a result of consumption of lubricant by the internal combustion engine 144, lubricant in the lubricant reservoir 148 will from time to time drop below a recommended level and will then be refilled from time to time with fresh lubricant. Consequently, lubricant exchanges between the lubricant reservoir 148 and the gearcase chamber 602 combined with the consumption and the refilling of lubricant will, at least in some applications, result in at least some of the fresh lubricant entering the gearcase chamber 602 from time to time and thereby refreshing lubricant in the gearcase chamber 602.

In some applications and depending on each particular implementation of the marine outboard engine 100, the refreshing of lubricant in the gearcase chamber 602 reduces a frequency with which the lubricant in the gearcase chamber 602 must be replaced. In some applications and depending on each particular implementation of the marine outboard engine 100, the refreshing of lubricant in the gearcase chamber 602 eliminates a need to replace lubricant in the gearcase chamber 602. Nonetheless, it is contemplated that the gearcase 110 could be provided with one or more conventionally known ports (not shown) for changing lubricant in the gearcase chamber 602. Such port(s) could be used, for example, during repairs and/or initial manufacturing of the marine outboard engine 100.

It is contemplated that in some implementations, and depending on the particular application of the marine outboard engine 100, the marine outboard engine 100 could include a pump for inducing and/or increasing lubricant exchanges between the lubricant reservoir 148 and the gearcase chamber 602 via the hose 336.

Turning now to FIGS. 4, 5 and 7, yet another portion of the lubrication system will be described in more detail. The engine assembly 106 includes a lubricant pan 442. In the present implementation, the lubricant pan 442 is a part of the lubricant reservoir 148 and is positioned above the crankcase 310 and the cylinder block 312.

The bearings 302, 304 and 306 are in fluid communication with the lubricant pan 442 and are lubricated by lubricant from the lubricant pan 442. More particularly, the bearings 302, 304 and 306 are open to the volume between the lubricant pan 442 and the engine cover 402 that defines the lubricant reservoir 148 so that lubricant from the lubricant pan 442 can contact the bearings 302, 304 and 306 when the marine outboard engine 100 is in use.

The bearings 302, 304 and 306 are also lubricated by a pumped supply of lubricant provided as described in more detail below. When lubricant 444 in the lubricant pan 442 drops below a certain level of lubricant (as a result of being consumed by the internal combustion engine 144), the pumped supply of lubricant becomes the main source of lubricant for the bearings 302, 304 and 306.

In the present implementation, the pumped supply of lubricant is provided as follows. As best shown in FIGS. 5 and 7, the recess 510 in the crankcase 310 has an inlet lubricant conduit 522 for receiving lubricant from the gearcase chamber 602, and an outlet lubricant conduit 524 for supplying lubricant from the recess 510 to the bearings 302, 304, 306. To prevent leakage of lubricant out of the recess 510 into the crankcase chamber 406 around the shaft 512 of the gear 506, a seal (not shown) is disposed radially between the shaft 512 and an inner wall of the recess 510.

As shown schematically in FIG. 3, a hose 338 extends from a nipple 526 at the distal end of the inlet lubricant conduit 522, through the mid-section 108, and to the rear end of the gearcase chamber 602, for supplying lubricant from the gearcase chamber 602 to the recess 510. It is contemplated that the hose 338 could be received in a different part of the gearcase chamber 602.

In the present implementation, the recess 510 is disposed below the top of the lubricant reservoir 148 and lubricant is thus gravity-fed by the lubricant reservoir 148 via the gearcase chamber 602. It is contemplated that the recess 510 could be disposed below a bottom (FIG. 6) of the lubricant reservoir 148. In either case, the hydrostatic pressure of the lubricant in the lubricant reservoir 148 pushes it downward through the hose 336 into the gearcase chamber 602, and from the gearcase chamber 602 upward through the hose 338 into the recess 510.

As shown schematically in FIG. 3, a hose 340 extends from a nipple 702 at the distal end of the outlet lubricant conduit 524, through the engine cover 402, and to the top of the upper output shaft 408 (above the bearing 302), for supplying lubricant from the recess 510 to the top of the upper output shaft 408. An outer surface of the shaft 512 of the gear 506 is disposed in the recess 510 and acts as a centrifugal impeller 528 that pumps lubricant from the recess 510 to the top of the upper output shaft 408 via the hose 340.

As best shown in FIG. 8, lubricant supplied to the top of the upper output shaft 408 via the hose 340 flows outwards and downwards to the bearing 302 by gravity, and downwards through an axial channel 342 defined in the upper output shaft 408. The axial channel 342 includes radial branches (not shown) that fluidly connect the axial channel 342 to the bearings 302, 304 and 306. Lubricant flows from the axial channel 342 through the radial branches to the bearings 302, 304 and 306 and lubricates the bearings 302, 304 and 306. This lubricant then flows to the lubricant pan 442 (and therefore also to the lubricant reservoir 148).

When lubricant 444 in the lubricant reservoir 148 is at a certain level of lubricant, the bearings 306 and 304 are lubricated by being at least partially submerged in lubricant present in the lubricant pan 442. When lubricant 444 in the lubricant reservoir 148 drops below a certain level of lubricant, the bearings 306 and 304 are lubricated by splashes of lubricant that occur in the lubricant reservoir 148 when the marine outboard engine 100 is in use.

When lubricant 444 in the lubricant reservoir 148 drops downwards even further, the pumped supply of lubricant to the bearings 302, 304 and 306 becomes the main lubricant supply to the bearings 302, 304 and 306. In implementations of the marine outboard engine 100 that do not have a pumped supply of lubricant to above the lubricant reservoir 148, the bearings 302, 304 and 306 are absent, and the upper output shaft 408 is supported by the bearing 308.

In the present implementation, the centrifugal impeller 528 pumps lubricant from the recess 510 to the top of the upper output shaft 408, and not necessarily from the gearcase chamber 602 to the recess 510, since, as described above, the recess 510 is gravity-fed by lubricant from the gearcase chamber 602. However, it is contemplated that the recess 510 could be disposed at least in part above the top of the lubricant reservoir 148, in which case the centrifugal impeller 528 would be sized to provide sufficient pumping for pumping lubricant from the gearcase 110 to the recess 510 and onwards to the top of the upper output shaft 408.

It is contemplated that components other than the gear 506 could pump lubricant out of the recess 510. It is contemplated that a different rotating component of the internal combustion engine 144, such the base of a balance shaft, could be adapted for pumping lubricant from the gearcase chamber 602 to the top of the upper output shaft 408. It is also contemplated that an electric lubricant pump could be used instead of or in addition to the gear 506 to lubricate the bearings 304, 302.

In a further aspect, it is contemplated that the marine outboard engine 100 could include other components, in addition to the bearings 302, 304, 306, requiring a pumped supply of lubricant. In such cases, the gear 506 could be used to supply lubricant from, for example, the gearcase chamber 602 to such other components. For example, in an implementation where the marine outboard engine 100 includes the secondary flywheel system referred to above, the gear 506 could be used to supply lubricant to bearings supporting the secondary flywheel of the secondary flywheel system.

In yet a further aspect, it is contemplated that the gear 506 could be used to induce and/or increase lubricant exchanges between the lubricant reservoir 148 and the gearcase chamber 602. However, it should be noted that, in at least some implementations, the gear 506 is not required to induce lubricant exchanges between the lubricant reservoir 148 and the gearcase chamber 602. To this end, it is contemplated that the lubricant return path defined by the hoses 338 and 340 and the gear 506 could be omitted, in which case there would be no lubricant outlet from the gearcase chamber 602 and lubricant in the gearcase chamber 602 would be refreshed as described above.

In the present implementation, although the internal combustion engine 144 is a two-stroke internal combustion engine, the lubricant is a four-stroke engine oil. More particularly, the four-stroke engine oil is an Evinrude Johnson Ultra (TM) four-stroke synthetic blend oil. It is contemplated that the lubricant could be a different four-stroke engine oil. It is contemplated that the lubricant could be a two-stroke engine oil. It is contemplated that the lubricant could be a non-oil-based lubricant. It is also contemplated that the lubricant could be a mixture comprising at least one of a four-stroke engine oil, a two-stroke engine oil and a non-oil-based lubricant.

Modifications and improvements to the above-described implementations of the present technology may become apparent to those skilled in the art. The foregoing description is intended to be exemplary rather than limiting.

The invention claimed is:

1. A marine outboard engine, comprising:
- an internal combustion engine comprising:
  - a crankcase defining a crankcase chamber,
- a cylinder block connected to the crankcase, the cylinder block defining a cylinder,
  - a piston disposed in the cylinder,
  - a crankshaft disposed at least in part in the crankcase chamber, and
  - a connecting rod operatively connecting the piston to the crankshaft;
  - a gearcase defining a gearcase chamber;
- a plurality of gears disposed in the gearcase chamber;
- a driveshaft operatively connecting the crankshaft to the plurality of gears;
- an output shaft disposed at least in part in the gearcase chamber and being operatively connected to the plurality of gears;
- a rotor connected to the output shaft for propelling the marine outboard engine;
- a lubricant reservoir for holding lubricant;
- a first lubricant conduit fluidly connecting the lubricant reservoir to the crankcase chamber for supplying lubricant from the lubricant reservoir to the crankcase chamber; and
- a second lubricant conduit fluidly connecting the lubricant reservoir to the gearcase chamber for supplying lubricant from the lubricant reservoir to the gearcase chamber.

2. The marine outboard engine of claim 1, wherein the lubricant reservoir is disposed at least in part in front of the crankcase.

3. The marine outboard engine of claim 1, wherein the lubricant reservoir is disposed at least in part above the internal combustion engine.

4. The marine outboard engine of claim 1, wherein the output shaft is operatively connected to the plurality of gears to be selectively drivable by at least two of the plurality of gears.

5. The marine outboard engine of claim 1, wherein the plurality of gears disposed in the gearcase chamber includes:
- a pinion connected to an end of the driveshaft to be driven by the driveshaft, and
- a bevel gear connected to the output shaft in front of the pinion, the bevel gear being meshed with the pinion and driven by the pinion in a first direction.

6. The marine outboard engine of claim 5, wherein the bevel gear is a first bevel gear;
- wherein the plurality of gears disposed in the gearcase chamber further includes a second bevel gear connected to the output shaft behind the pinion, the second bevel gear being meshed with the pinion and driven by the pinion in a second direction that is opposite the first direction; and further comprising a dog clutch disposed in the gearcase chamber, the dog clutch being operable to selectively couple one of the first bevel gear and the second bevel gear to the output shaft to drive the output shaft in a corresponding one of the first and second direction.

7. The marine outboard engine of claim 1, further comprising a lubricant in the lubricant reservoir, the lubricant in the lubricant reservoir being a four-stroke engine oil, and the internal combustion engine being a two-stroke internal combustion engine.

8. The marine outboard engine of claim 1, further comprising a lubricant pump fluidly connecting the lubricant reservoir to the crankcase chamber via the first lubricant conduit for supplying lubricant from the lubricant reservoir to the crankcase chamber.

9. The marine outboard engine of claim 1, further comprising a plurality of bearings rotationally connecting the crankshaft to the crankcase, the plurality of bearings being in fluid communication with the lubricant reservoir for receiving lubricant from the lubricant reservoir.

10. The marine outboard engine of claim 1, further comprising a wristpin operatively connecting the piston to the connecting rod, the wristpin being in fluid communication with the lubricant reservoir for receiving lubricant from the lubricant reservoir.

11. The marine outboard engine of claim 10, further comprising a third lubricant conduit fluidly connecting the lubricant reservoir to the wristpin for supplying lubricant from the lubricant reservoir to the wristpin.

12. The marine outboard engine of claim 11, further comprising a crankpin operatively connecting the connecting rod to the crankshaft, the first conduit supplying lubricant from the lubricant reservoir to the crankpin.

13. The marine outboard engine of claim 1, further comprising a third lubricant conduit fluidly connecting the gearcase chamber to the lubricant reservoir for returning lubricant from the gearcase chamber to the lubricant reservoir.

14. The marine outboard engine of claim 1, further comprising a third lubricant conduit fluidly connecting the gearcase chamber to the internal combustion engine for supplying lubricant from the gearcase chamber to the internal combustion engine.

15. The marine outboard engine of claim 14, wherein the internal combustion engine includes a rotating component being rotationally mounted to the crankcase and operatively connected to the crankshaft to be driven by the crankshaft, the rotating component supplying lubricant from the third lubricant conduit to at least one other component of the internal combustion engine.

16. The marine outboard engine of claim 15, wherein:

the internal combustion engine includes an auxiliary bearing disposed outside of the crankcase chamber; and the at least one other component of the internal combustion engine is the auxiliary bearing.

17. The marine outboard engine of claim 16, further comprising a fourth lubricant conduit fluidly connecting an outer surface of the rotating component to the lubricant reservoir for supplying lubricant from the third fluid conduit to the lubricant reservoir.

18. The marine outboard engine of claim 17, wherein the outer surface of the rotating component defines a centrifugal impeller for centrifugally pumping lubricant from the third lubricant conduit to the auxiliary bearing.

19. The marine outboard engine of claim 18, wherein the centrifugal impeller is disposed below the top of the lubricant reservoir.

20. The marine outboard engine of claim 19, wherein the centrifugal impeller is disposed below a bottom of the lubricant reservoir.

* * * * *